US008714230B2

(12) United States Patent
Marszalek et al.

(10) Patent No.: US 8,714,230 B2
(45) Date of Patent: May 6, 2014

(54) FABRIC SECURITY BARRIER, SYSTEM AND/OR METHOD FOR IMPEDING ENTRY INTO A SPACE

(75) Inventors: Christopher Marszalek, Plainfield, IL (US); James Patten, Downers Grove, IL (US)

(73) Assignee: Sennco Solutions, Inc., Plainfield, IL (US)

( * ) Notice: Subject to any disclaimer, the term of this patent is extended or adjusted under 35 U.S.C. 154(b) by 445 days.

(21) Appl. No.: 13/065,648

(22) Filed: Mar. 25, 2011

(65) Prior Publication Data

US 2012/0241108 A1 Sep. 27, 2012

(51) Int. Cl.
*E06B 9/11* (2006.01)

(52) U.S. Cl.
USPC ..... 160/264; 160/121.1

(58) Field of Classification Search
USPC ..... 160/120, 121.1, 98, 352, 133, 108, 238, 160/309, DIG. 18, 264, 405, 267.1, 268.1, 160/271, 273.1, 179; 40/601
See application file for complete search history.

(56) References Cited

U.S. PATENT DOCUMENTS

| | | | | | |
|---|---|---|---|---|---|
| 1,925,815 | A * | 9/1933 | Nicolson | 135/97 |
| 1,959,136 | A * | 5/1934 | Miller | 160/268.1 |
| 2,455,237 | A * | 11/1948 | Davis | 410/97 |
| 2,559,301 | A * | 7/1951 | Jones | 160/108 |
| 2,756,438 | A * | 7/1956 | Soberman | 4/608 |
| 2,840,158 | A * | 6/1958 | Lee | 160/327 |
| 2,844,196 | A * | 7/1958 | Jones | 160/26 |
| 3,205,118 | A * | 9/1965 | Guffan | 160/238 |
| 3,844,277 | A * | 10/1974 | Pahl | 601/144 |
| 4,350,380 | A * | 9/1982 | Williams | 294/74 |
| 5,123,474 | A * | 6/1992 | Smith | 160/310 |
| 5,199,479 | A * | 4/1993 | Kraeutler | 160/84.06 |
| 5,323,835 | A * | 6/1994 | Bachmeier | 160/89 |
| 5,351,738 | A * | 10/1994 | Petersen et al. | 160/120 |
| 5,427,169 | A * | 6/1995 | Saulters | 160/368.1 |
| 5,738,160 | A * | 4/1998 | Rice | 160/84.06 |
| 5,860,350 | A * | 1/1999 | Rexroad | 87/6 |
| 6,059,005 | A * | 5/2000 | Zinbarg | 160/90 |
| 6,079,473 | A * | 6/2000 | Ackerson et al. | 160/368.1 |
| 6,691,761 | B1 * | 2/2004 | Alkhoury et al. | 160/273.1 |
| 6,705,378 | B1 * | 3/2004 | Smidt | 160/120 |
| 6,755,232 | B1 * | 6/2004 | Holland et al. | 160/368.1 |
| 6,851,903 | B1 * | 2/2005 | Foggy | 410/118 |
| 7,080,967 | B2 * | 7/2006 | Ackerman et al. | 410/118 |
| 7,154,039 | B1 | 12/2006 | Marszalek et al. | |
| 7,202,417 | B2 | 4/2007 | Marszalek et al. | |

(Continued)

OTHER PUBLICATIONS

U.S. Appl. No. 12/802,644, Horvath et al.

(Continued)

*Primary Examiner* — David Purol
(74) *Attorney, Agent, or Firm* — Patents+TMS, P.C.

(57) ABSTRACT

A fabric security barrier, a system and/or a method impede entry into a space. The fabric security barrier, the system and/or the method are installed adjacent to an entry point of the space. A tarp having a reinforced webbing on one side obscured from view is extended and/or retracted by a deployment system within the space. A steel cable is laminated between the reinforced webbing and the tarp. To enter the space through the entry point, an intruder must compromise a door or a window, the tarp, the reinforced webbing and/or the cable which may reduce an amount of time that the intruder may have to perpetrate a crime in the space and/or to flee before being noticed and/or apprehended.

19 Claims, 4 Drawing Sheets

(56) References Cited

U.S. PATENT DOCUMENTS

| | | | | |
|---|---|---|---|---|
| 7,202,786 | B2 | 4/2007 | Marszalek et al. | |
| 7,223,917 | B1 | 5/2007 | Marszalek et al. | |
| 7,320,353 | B1 * | 1/2008 | Miller et al. | 160/89 |
| 7,387,003 | B2 | 6/2008 | Marszalek et al. | |
| 7,487,652 | B2 | 2/2009 | Marszalek et al. | |
| 7,504,944 | B2 | 3/2009 | Marszalek et al. | |
| 7,592,548 | B2 | 9/2009 | Marszalek et al. | |
| 7,593,142 | B2 | 9/2009 | Marszalek et al. | |
| 7,714,722 | B2 | 5/2010 | Marszalek et al. | |
| D616,778 | S | 6/2010 | Marszalek et al. | |
| 8,235,086 | B2 * | 8/2012 | Smith | 160/122 |
| 8,292,559 | B1 * | 10/2012 | Foggy | 410/96 |
| 2006/0124252 | A1 * | 6/2006 | Miller et al. | 160/113 |
| 2006/0248781 | A1 | 11/2006 | Horvath et al. | |
| 2007/0079942 | A1 * | 4/2007 | Snyder et al. | 160/113 |
| 2007/0113973 | A1 | 5/2007 | Marszalek et al. | |
| 2008/0047178 | A1 | 2/2008 | Marszalek et al. | |
| 2008/0131226 | A1 * | 6/2008 | Pesson | 410/129 |
| 2008/0204239 | A1 | 8/2008 | Marszalek et al. | |
| 2009/0058643 | A1 | 3/2009 | Groth | |
| 2009/0266963 | A1 | 10/2009 | Marszalek et al. | |
| 2010/0301998 | A1 | 12/2010 | Marszalek et al. | |
| 2011/0000626 | A1 * | 1/2011 | Miller et al. | 160/89 |
| 2011/0061817 | A1 * | 3/2011 | Smith | 160/121.1 |
| 2011/0084689 | A1 | 4/2011 | Groth et al. | |
| 2011/0219826 | A1 * | 9/2011 | Jeli et al. | 70/15 |
| 2012/0241108 | A1 * | 9/2012 | Marszalek et al. | 160/264 |
| 2012/0267058 | A1 * | 10/2012 | Smith | 160/121.1 |
| 2012/0317781 | A1 * | 12/2012 | Slutz | 29/428 |
| 2012/0321409 | A1 * | 12/2012 | Lesley | 410/100 |
| 2012/0328685 | A1 * | 12/2012 | Stutz et al. | 424/412 |

OTHER PUBLICATIONS

"Sunbrella 46 & 60 In.", Solution-Dyed Woven Acrylic Basic Fabric Specifications.

"Webbing Nylon", TriVintage eCatalog Website, http://catalog.trivantage.com/storefrontB2BWEB/, Jan. 5, 2011.

"Wire Rope Guidelines", Diameter Selection Criteria, Breaking Strength Selection Criteria and Construction Class Selection Criteria, 2007.

"Operators Type 5DMI Override (120V-60 Hz) AC", Simu Motor.

"The New Telis Collection Brightens the Future of Radio Technology Somfy (RTS)", Promotional Flyer.

"GE Security KeySafe Pro, Pushbutton, Black", Grainger Website, http://www.grainer.com/, Jan. 5, 2011.

"Precontraint 502: Solar Protection", Ferrari Architecture Brochure, Feb. 2010.

"Sunbrella Fabric", Glen Raven Custom Fabrics, LLC Brochure, 2011.

"Firesist Fabric", Glen Raven Custom Fabrics, LLC Brochure.

"Weathertyte Advanced Awning Fabric", TriVantage Brochure.

"Phifertex Casual Furniture and Awning Fabric", TriVantage Brochure.

* cited by examiner

FABRIC SECURITY BARRIER, SYSTEM AND/OR METHOD FOR IMPEDING ENTRY INTO A SPACE

BACKGROUND OF THE INVENTION

The present invention generally relates to a fabric security barrier, a system and/or a method for impeding entry into a space. The space may be enclosed by, for example, a building, a room, a hallway, a vault, a closet, a vehicle, a shed, a kiosk, a storage locker, a semi-trailer, a cargo container and/or the like. More specifically, the present invention relates to a fabric security barrier, a system and/or a method that may be used adjacent to an entry point of the space, such as, for example, a door, a window and/or the like to interfere with and/or to slow a progress of an unwanted and/or an undesired intrusion. The fabric security barrier, the system and/or the method may have a fabric tarp that may be pliable and/or that may be provided on one side of the fabric tarp with a reinforced webbing. The reinforced webbing may have a cable, such as, for example, galvanized steel or stainless steel rope that may be positioned between the webbing and the fabric tarp. The fabric security barrier may be installed into a deployment system to extend and/or to retract the fabric security barrier between the entry point and the space that may house, for example, retail goods. To enter the space through the entry point, an intruder must compromise a door or window and must overcome the fabric tarp, the reinforced webbing and/or the cable which may reduce an amount of time that the intruder may have to intrude the space and flee before being noticed and/or apprehended.

It is generally known that a business may store, transport, warehouse and/or display inventory and assets in one or more structures, such as, for example, buildings, warehouses, offices, retail outlets, rooms, closets, hallways, vaults, vehicles, sheds, kiosks, storage lockers, semi-trailers, cargo containers and/or the like. Further, it is known that these structures have entry points, such as, for example, doors, windows, skylights, cargo bays, loading docks and/or the like. Many of the entry points are provided with glass which may allow patrons, clients, passers-by and/or the like with a line of sight into the structure. Entry points are commonly used by intruders, such as, for example, would-be thieves to enter and/or to exit the structure during thefts. Known security systems are provided at entry points to prevent or impede passage, to visually deter the intruder from targeting the structure for theft and/or to notify law enforcement officials and/or security personnel of a possible intrusion-in-progress.

Known systems for preventing and/or impeding passage at the entry points include mechanical deterrents, such as, for example, security gates, window bars, pad lock systems, industrial doors, metal shutters and/or the like which may further operate to visually deter the would-be thief. However, the mechanical deterrents are aesthetically displeasing and/or unsightly. Further, the mechanical deterrents are heavy because they are constructed almost exclusively from metallic materials, such as, for example, steel, wrought iron, aluminum and/or the like. A weight of the mechanical deterrents makes the mechanical deterrents more difficult to deploy and/or to retract on a regular basis. Even further, most mechanical deterrents are rigid and typically require more space to store when not in use and often require larger and more powerful motors for periodic deployment.

Moreover, mechanical deterrents are associated with undesirable locations, such as, for example, neighborhoods where instances of theft and/or crime may be higher. As a result, businesses, such as, for example, retailers may desire to avoid using known mechanical deterrents, especially at entry points having glass where the mechanical deterrents are visible to clients and/or patrons during and/or after business hours. While the known mechanical deterrents may be effective at stopping or slowing entry of an intruder, many businesses avoid using known mechanical deterrents for the reasons identified above. In lieu of mechanical deterrents, businesses utilize known systems for detecting unauthorized entry and/or for notifying law enforcement officials of unauthorized entry.

Known systems for detecting unauthorized entry and/or for notifying law enforcement officials of a possible intrusion-in-progress include electronic monitoring systems that may incorporate glass-break sensors, window/door ajar sensors, motion sensors, trip lasers, camera surveillance equipment and/or the like. The electronic monitoring systems are often used at entry points without accompanying mechanical deterrents. An intruder may break a glass window or a door, open a window or a door, and/or enter the structure, for example, to perpetrate the theft. The electronic monitoring systems may sound an alarm and may notify law enforcement officials of a possible intrusion in progress. However, a period of time elapses before the law enforcement officials respond. The period of time may be seconds to minutes; however, the intruder, if physically undeterred, may have ample time to enter the structure, to perpetrate a theft and to flee the premises before law enforcement officials arrive.

A need, therefore, exists for a fabric security barrier, a system and/or a method for impeding entry into a space that may be enclosed by, for example, a building, a room, a hallway, a vault, a vehicle, a shed, a kiosk, a storage locker, a semi-trailer, a cargo container and/or the like. Additionally, a need exists for a fabric security barrier, a system and/or a method that may be used in conjunction with electronic monitoring systems adjacent to an entry point of the space to interfere with and/or to slow a progress of an intruder to allow time for law enforcement officials to arrive. Further, a need exists for a fabric security barrier, a system and/or a method that may be aesthetically pleasing. Still further, a need exists for a fabric security barrier, a system and/or a method that may have reinforced webbing on a back side of the fabric security barrier in a position that may not be visible to the public and/or the intruder. Still further, a need exists for a fabric security barrier, a system and/or a method that may be pliable and/or that may require minimal storage space while not deployed. Still further, a need exists for a fabric security barrier, a system and/or a method that may be rolled onto a tube or drum while not deployed. Still further, a need exists for a fabric security barrier, a system and/or a method that may be lightweight and easy to install. Still further, a need exists for a fabric security barrier, a system and/or a method that may increase an energy efficiency of the space. Still further, a need exists for a fabric security barrier, a system and/or a method that may display indicia, such as, for example, advertisements, designs and/or logos on a front side of the fabric security barrier that may be visible to the public. Still further, a need exists for a fabric security barrier, a system and/or a method that may be modular and/or that may be scalable to fit entry points of various sizes and configurations. Still further, a need exists for a fabric security barrier, a system and/or a method that may be more cost effective than known mechanical deterrents. Still further, a need exists for a fabric security barrier, a system and/or a method that may be used with extension/retraction systems for deployment by an electric motor and/or by hand. Still further, a need exists for a fabric security barrier, a system and/or a method that may be flame retardant. Moreover, a need exists for a fabric security barrier, a system and/or a method that may obscure the space from view through the entry point by persons outside of the building.

SUMMARY OF THE INVENTION

The present invention generally relates to a fabric security barrier, a system and/or a method for impeding entry into a space. The fabric security barrier may have a fabric tarp that may be sized to cover an entry point of the space, such as, for example, a door, a window and/or the like. The fabric tarp may be a sheet of fabric, such as, for example, a woven and/or a non-woven fabric. The sheet of fabric may have a first side and a second side that may be positioned opposite to the first side. The first side may be positioned facing towards an outside of the space. The second side may be positioned facing towards an inside of the space. The sheet of fabric may have a first end and second end that may be positioned opposite to the first end. The sheet of fabric may have a top end and a bottom end that may be positioned opposite to the top end. A reinforced webbing may be affixed to the second side of the sheet of fabric in, for example, a lattice or criss cross pattern. The webbing may extend both vertically and/or horizontally across the second side of the sheet of fabric.

A cable, such as, for example, galvanized steel or stainless steel rope may be positioned between the webbing and the sheet of fabric. The first end and the second end of the fabric and/or portions of the cable extending from the fabric security barrier at the first end and the second end of the sheet of fabric may be engaged in a railing system that may be installed adjacent to both sides of the entry point. The railing system may prevent the fabric security barrier from being maneuvered from its position covering the entry point and/or may allow the fabric security barrier to be raised and/or lowered by a deployment system. The fabric security barrier may be provided with a hem bar that may extend between the first end and the second end of the sheet of fabric at the bottom end of the sheet of fabric. The hem bar may be weighted and/or may maintain a tension in the barrier that may be required to smoothly raise and/or lower the barrier on the railing system.

To this end, in an embodiment of the present invention, a security barrier for impeding entry into a space is provided. The security barrier has a tarp having a length defined between a first end and a second end wherein the second end is positioned opposite to the first end wherein the tarp has a thickness defined between a front side and a back side wherein the back side is positioned opposite to the front side wherein the tarp has a height defined between a top end and a bottom end wherein the bottom end is positioned opposite to the top end wherein the tarp is constructed from a pliable fabric. Further, the security barrier has a first plurality of straps affixed to the back side of the tarp wherein the first plurality of straps extend from the first end of the tarp to the second end of the tarp wherein the first plurality of straps is constructed from a webbing material. Still further, the security barrier has a second plurality of straps affixed to the back side of the tarp wherein the second plurality of straps extend from the bottom end of the tarp to a point between the bottom end of the tarp and the top end of the tarp wherein each of the second plurality of straps intersects with each of the first plurality of straps wherein the second plurality of straps is constructed from the webbing material. Still further, the security barrier has a first plurality of cables each having a first end and second end wherein each of the first plurality of cables is positioned between each of the first plurality of straps and the back side of the tarp wherein each of the first plurality of cables extends from the first end of the tarp to the second end of the tarp wherein the first plurality of cables is constructed from a wire rope. Moreover, the security barrier has a second plurality of cables each having a first end and a second end wherein each of the second plurality of cables is positioned between each of the second plurality of straps and the back side of the tarp wherein each of the second plurality of cables extends from the bottom end of the tarp to the point between the bottom end of the tarp and the top end of the tarp wherein the second plurality of cables is constructed from the wire rope.

In an embodiment, the security barrier has a hem bar attached to the bottom end of the tarp that extends from the first end of the tarp to the second end of the tarp wherein the hem bar places tension on the tarp with a force of gravity.

In an embodiment, the security barrier has zippers attached to the first end and the second end of the tarp that extend from the bottom end of the tarp to a point adjacent to the top end of the tarp.

In an embodiment, the security barrier has a section of the tarp between the point and the top end of the tarp that is devoid of the first plurality of straps, the second plurality of straps, the first plurality of cables and the second plurality of cables.

In an embodiment, the security barrier has an end stop attached to each of the first end and the second end of each of the first plurality of cables and each of the second plurality of cables wherein the end stop prevents each of the first plurality of cables and each of the second plurality of cables from being maneuvered with respect to the back side of the tarp.

In an embodiment, the security barrier has a fabric strip positioned between each of the first plurality of cables and the back side of the tarp and between each of the second plurality of cables and the back side of the tarp.

In an embodiment, the security barrier has strips of the pliable fabric laminated to the first end and the second end of the tarp to reinforce the first end and the second end of the tarp.

In an embodiment, the pliable fabric is selected from the group consisting of a woven fabric, a non-woven fabric, a canvas fabric, a cloth fabric, an acrylic fabric, a vinyl fabric, a solution-dyed acrylic fabric and a vinyl coated woven fabric.

In an embodiment, the wire rope is constructed from the group consisting of galvanized steel, stainless steel and aluminum.

In an embodiment, the webbing material is a nylon webbing.

In an embodiment, the tarp is opaque.

In another embodiment, a system for securing an entry point of a space is provided. The system has a barrier sized to cover the entry point wherein the barrier has a first end and a second end wherein the second end is positioned opposite to the first end wherein the barrier has a front side and a back side wherein the back side is positioned opposite to the front side wherein the barrier has a top end and a bottom end wherein the bottom end is positioned opposite to the top end wherein the barrier is pliable. Further, the system has a webbing attached to the back side of the barrier wherein the webbing is positioned in a criss cross pattern wherein the webbing is reinforced with a wire rope between the webbing and the back side of the barrier. Still further, the system has a roller tube installed within the space above the entry point wherein the top end of the barrier attaches to the roller tube wherein the roller tube rotates to extend and retract the barrier. Moreover, the system has rails installed adjacent to the entry point wherein the rails receive the first end and the second end of the barrier wherein the rails guide an extension and a retraction of the barrier and further wherein the rails maintain a horizontal tension in the barrier.

In an embodiment, the system has a motor attached to the roller tube to rotate the roller tube.

In an embodiment, the system has means for manually rotating the roller tube.

In an embodiment, the system has a control system remotely located with respect to the roller tube wherein the control system controls rotation of the roller tube.

In an embodiment, the system has indicia displayed on the front side of the barrier.

In another embodiment, a method for interfering with a progress of an unwanted intrusion through an entry point of a space wherein the entry point is monitored by an electronic security system is provided. The method has the step of providing a barrier having a tarp with a front side and a back side wherein the tarp has a cable-reinforced nylon webbing attached to the back side of the tarp in a lattice pattern wherein the barrier is sized to cover the entry point wherein the barrier has a deployment system to raise and lower the barrier and further wherein the barrier has an end retention system to maintain a position of the barrier over the entry point. Further, the method has the step of lowering the barrier through the end retention system with the front side facing the entry point to cover the entry point within the space. Moreover, the method has the step arming the electronic security system.

In an embodiment, the method has the step of raising the barrier from the end retention system to uncover the entry point.

In an embodiment, the method has the step of displaying indicia on the front side of the tarp.

In an embodiment, the method has the step of positioning the barrier with the back side of the tarp facing into the space to obscure the cable-reinforced nylon webbing from view through the entry point.

It is, therefore, an advantage of the present invention to provide a fabric security barrier, a system and/or a method for impeding entry into a space that may be enclosed by, for example, a building, a room, a hallway, a container, a vault, a vehicle, a shed, a kiosk, a storage locker, a semi-trailer, a cargo container and/or the like.

Another advantage of the present invention is to provide a fabric security barrier, a system and/or a method for impeding entry into a space that may be used within the space adjacent to an entry point of the space, such as, for example, a door or a window to interfere with and/or to slow a progress of a would-be thief.

And, another advantage of the present invention is to provide a fabric security barrier, a system and/or a method for impeding entry into a space that may have a fabric tarp that may be provided on one side of the fabric tarp with a reinforced webbing.

Yet another advantage of the present invention is to provide a fabric security barrier, a system and/or a method for impeding entry into a space that may have a cable, such as, for example, galvanized steel or stainless steel rope that may be positioned between the webbing and the fabric tarp.

A further advantage of the present invention is to provide a fabric security barrier, a system and/or a method for impeding entry into a space that may be installed into a rolling curtain system to extend and/or retract the fabric security barrier between the entry point and the space, such as, for example a retail store.

Moreover, an advantage of the present invention is to provide a fabric security barrier, a system and/or a method for impeding entry into a space that may be used in conjunction with an electronic monitoring system adjacent to an entry point of the space to interfere with and/or to slow a progress of an intruder, such as, for example, a would-be thief to allow time for law enforcement officials to arrive.

And, another advantage of the present invention is to provide a fabric security barrier, a system and/or a method for impeding entry into a space that may be aesthetically pleasing.

Yet another advantage of the present invention is to provide a fabric security barrier, a system and/or a method for impeding entry into a space that may have reinforced webbing that may not be visible to the public.

Another advantage of the present invention is to provide a fabric security barrier, a system and/or a method for impeding entry into a space that may be lightweight and easy to install.

Yet another advantage of the present invention is to provide a fabric security barrier, a system and/or a method for impeding entry into a space that may increase a heating efficiency and/or a cooling efficiency of the space.

A still further advantage of the present invention is to provide a fabric security barrier, a system and/or a method for impeding entry into a space that may display indicia, such as, for example, advertisements, patterns, designs and/or logos on a front side that may be visible to the public.

Moreover, an advantage of the present invention is to provide a fabric security barrier, a system and/or a method for impeding entry into a space that may be modular and/or may be scalable to fit entry points of various sizes.

And, another advantage of the present invention is to provide a fabric security barrier, a system and/or a method for impeding entry into a space that is cost effective.

Yet another advantage of the present invention is to provide a fabric security barrier, a system and/or a method for impeding entry into a space that may be used with existing extension/retraction systems for deployment by an electric motor and/or by hand.

And, another advantage of the present invention is to provide a fabric security barrier, a system and/or a method for impeding entry into a space that may require minimal storage space while not deployed.

A still further advantage of the present invention is to provide a fabric security barrier, a system and/or a method for impeding entry into a space that may be flame retardant.

And, another advantage of the present invention is to provide a fabric security barrier, a system and/or a method for impeding entry into a space that may be manufactured in a variety of colors, patterns and/or opacities.

Yet another advantage of the present invention is to provide a fabric security barrier, a system and/or a method for impeding entry into a space wherein the fabric security barrier may be pliable and/or may be rolled onto a tube or drum while not deployed.

Moreover, an advantage of the present invention is to provide a fabric security barrier, a system and/or a method for impeding entry into a space that may obscure the space from view through the entry point.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
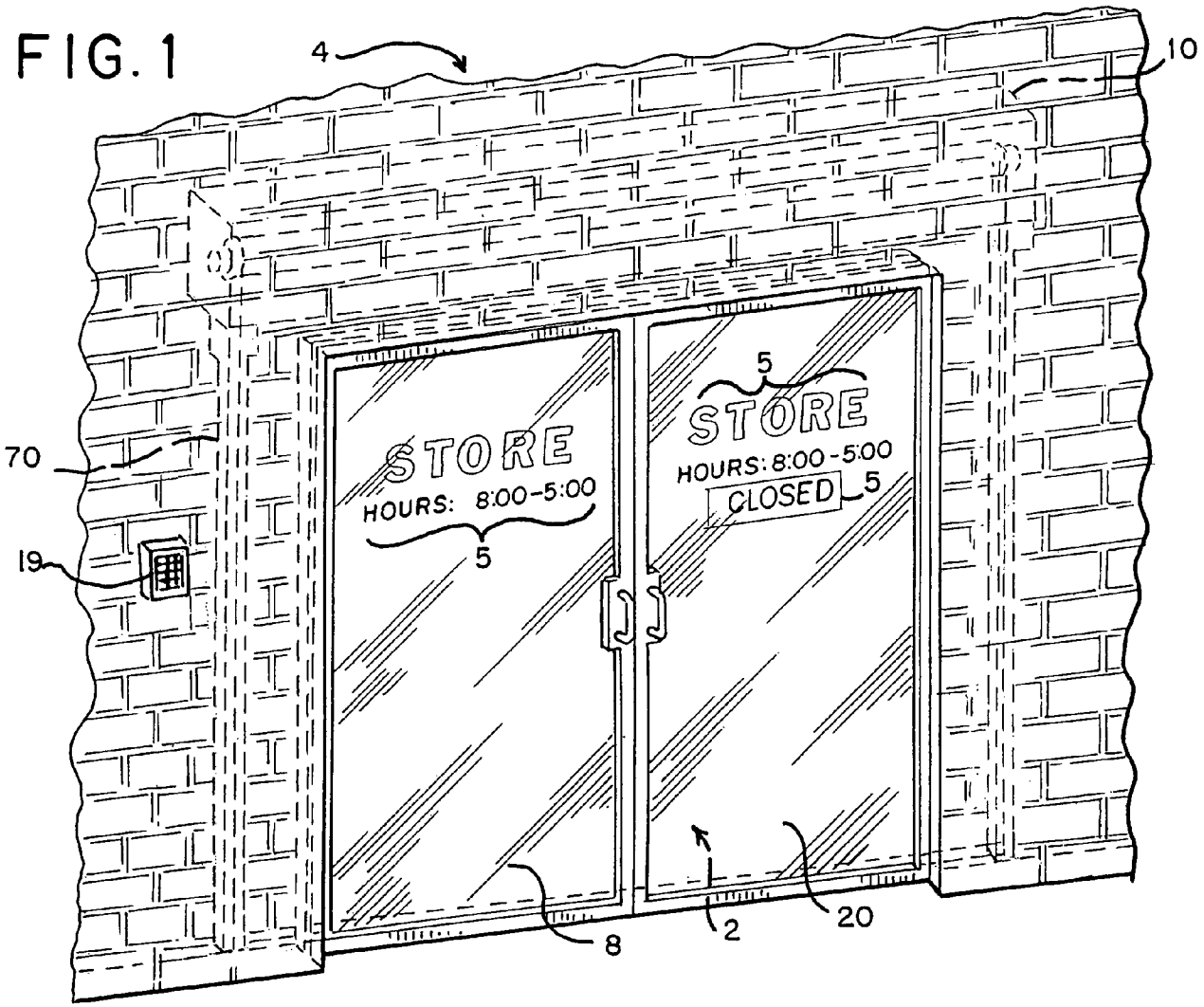
FIG. 1 illustrates a front side perspective view of a fabric security barrier and a system for impeding entry into a space in an embodiment of the present invention.

The present invention generally relates to a fabric security barrier, a system and/or a method for impeding entry into a space. The space may be enclosed by, for example, a building, a room, a hallway, a vault, a vehicle, a shed, a kiosk, a storage locker, a semi-trailer, a cargo container and/or the like. More specifically, the present invention relates to a fabric security barrier, a system and/or a method that may be used adjacent to an entry point of the space to interfere with and/or to slow a progress of a person, such as, for example, an intruder attempting to gain an unauthorized access to the space through means, such as, for example, breaking and entering a premises. The present invention should not be deemed as limited to a specific embodiment of the space and/or the person attempting to gain the unauthorized access. It should be understood that the space and/or the person may be any space that may be enclosed and/or any person to whom access to the space is not desired, respectively, as known to one having ordinary skill in the art.

Referring now to the drawings wherein like numerals refer to like parts, FIGS. 1-8 illustrate a fabric security barrier 2, a system 4 and/or components of the fabric security barrier 2 and/or of the system 4 for impeding entry into a space 6, such as, for example, an inside of a building, a room, a hallway, a vault, a vehicle, a shed, a kiosk, a storage locker, a semi-trailer, a cargo container and/or the like. The space may be, for example, a retail store, a house, an apartment, a warehouse, an office, a distribution center and/or the like that may be used to store, to use and/or to display items. It may be desirable to restrict physical access to the space for any of a number of reasons, such as for example, security of goods, crowd control, noise reduction, heating/cooling efficiency, privacy and/or the like. A person, such as, for example, a would-be thief may desire to gain unauthorized entry into the space 6 via an entry point 8, such as, for example, a door, a window, a skylight, a cargo bay, a loading dock and/or the like. In some cases, the entry point 8 may be constructed from a translucent material and/or a transparent material, such as, for example, glass and may allow one to view into the space 6.

Further, the entry point 8 may be secured by any of a variety of electronic monitoring security systems, such as, for example, glass-break sensors, window/door ajar sensors, motion sensors, trip lasers, camera surveillance equipment and/or the like. The electronic monitoring security systems may be used to detect an unauthorized entry and/or to notify security personnel and/or law enforcement authorities of an unauthorized entry in progress. The present invention should not be deemed as limited to a specific embodiment of the space 6, the entry point 8 and/or the electronic monitoring security systems. It should be understood that the space 6, the entry point 8 and/or the electronic monitoring security systems may be any space requiring secure enclosure, any entry point for gaining access to the space 6 and/or any electronic monitoring security systems for monitoring unauthorized entries, respectively, as known to one having ordinary skill in the art.

Figure 4:
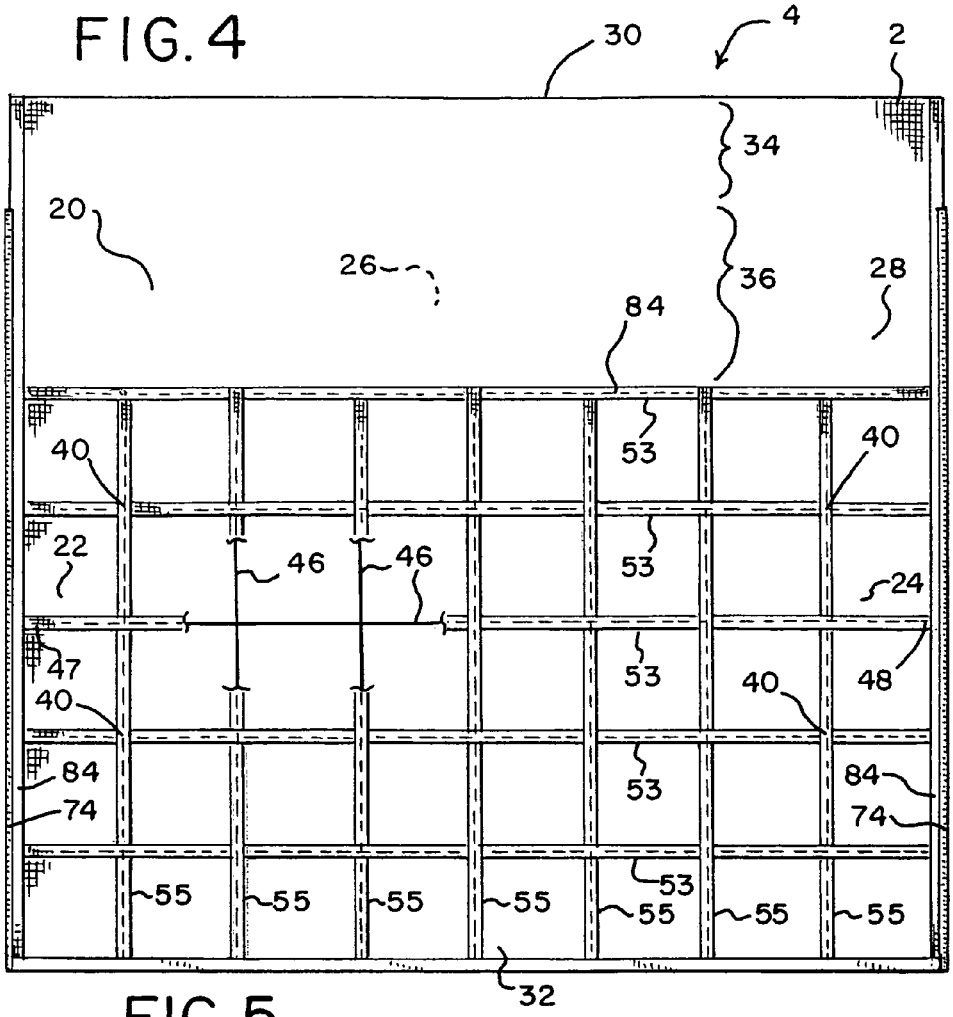
FIG. 4 illustrates a back side plan view of a fabric security barrier and a system for impeding entry into a space in an embodiment of the present invention.
Figure 7:
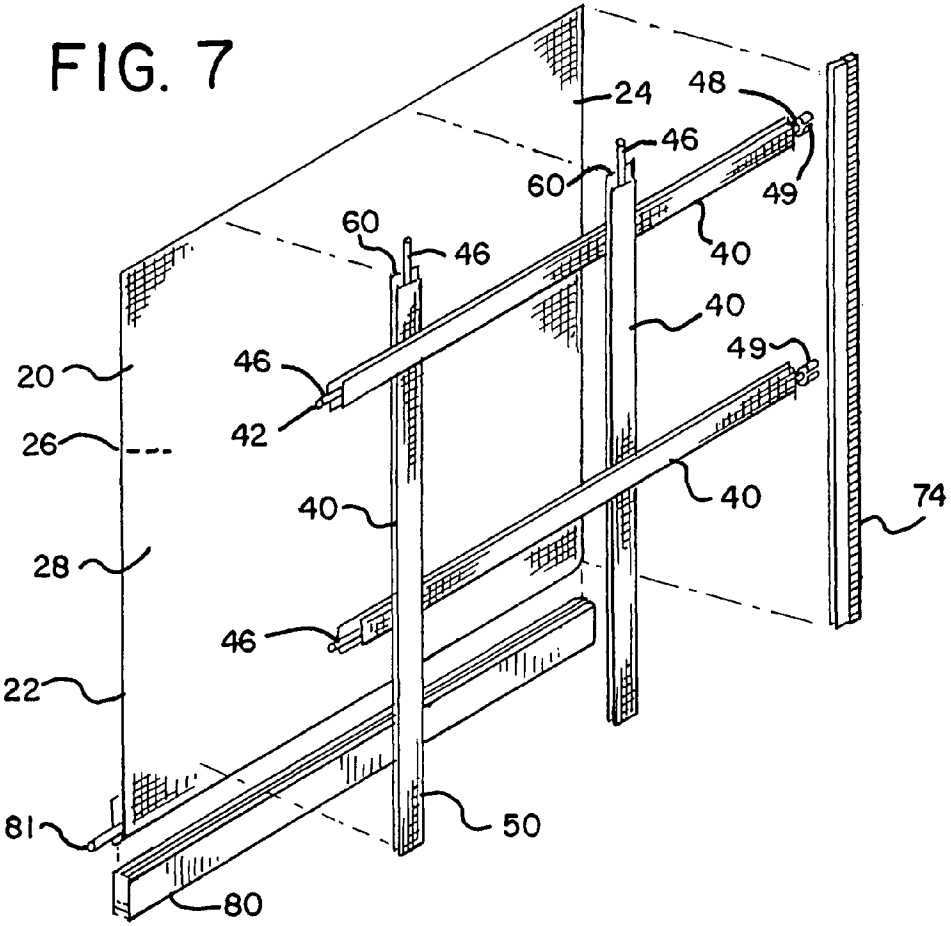
FIG. 7 illustrates a partial exploded back side perspective view of a fabric security barrier and a system for impeding entry into a space in an embodiment of the present invention.

As shown in FIGS. 4 and 7, the fabric security barrier 2 may be constructed from a fabric tarp 20 that may be sized to cover the entry point 8. The fabric tarp 20 may have a length defined between a first end 22 and a second end 24 that may be positioned opposite to the first end 22. The fabric tarp 20 may have a thickness defined between a front side 26 and a back side 28 that may be positioned opposite to the front side 26. The fabric tarp 20 may have a height defined between a top end 30 and a bottom end 32 that may be positioned opposite to the top end 30. In a preferred embodiment, the fabric tarp 20 may be generally rectangular in shape.

The fabric tarp 20 may be constructed from one or more sheets of fabric, such as, for example, a woven fabric and/or a non-woven fabric. The sheet of fabric may be, for example, a canvas fabric, a cloth fabric, an acrylic fabric, a vinyl fabric and/or the like. In a preferred embodiment, the sheet of fabric may be, for example, a solution-dyed acrylic fabric, a vinyl coated woven fabric and/or the like. The sheet of fabric may be pliable and/or may be rolled onto a tube and/or drum. The fabric tarp 20 may be constructed by attaching two or more sheets of fabric at vertical seems that may extend from the bottom end 32 of the fabric tarp 20 to the top end 30 of the fabric tarp 20. The sheets of fabric may be attached using heat and/or pressure to fuse the sheets of fabric, and/or the sheets of fabric may be stitched together using, for example, a polyester thread. In a preferred embodiment, the fabric tarp 20 may be opaque and/or may obscure the space 6 by preventing persons outside the space 6 from looking into the space 6 through the entry point 8. The fabric tarp 20 may be transparent and/or translucent. The present invention should not be deemed as limited to a specific embodiment of the fabric tarp 20. It should be understood that the fabric tarp 20 may be constructed from any pliable material that may be rolled on and/or unrolled from a tube or drum as known to one having ordinary skill in the art.

As shown in FIG. 1, the front side 26 of the fabric tarp 20 may be positioned within the space 6 adjacent to the entry point 8. The front side 26 of the fabric tarp 20 may be positioned to face towards an outside of the space 6. The front side 26 of the fabric tarp 20 may display indicia 5, such as, for example, letters, numerals, words, advertisements, logos, designs, patterns and/or the like. The indicia 5 may be applied to the front side 26 of the fabric tarp 20 using, for example, printing, painting, silk-screening, thermal transfers, adhesives, epoxies and/or the like. The indicia 5 may be constructed to withstand repetitive rolling and un-rolling of the fabric tarp 20. The present invention should not be deemed as limited to a specific embodiment of the indicia 5. It should be understood that the indicia 5 may be applied to the fabric tarp 20 using any method as known to one having ordinary skill in the art.

Figure 2:
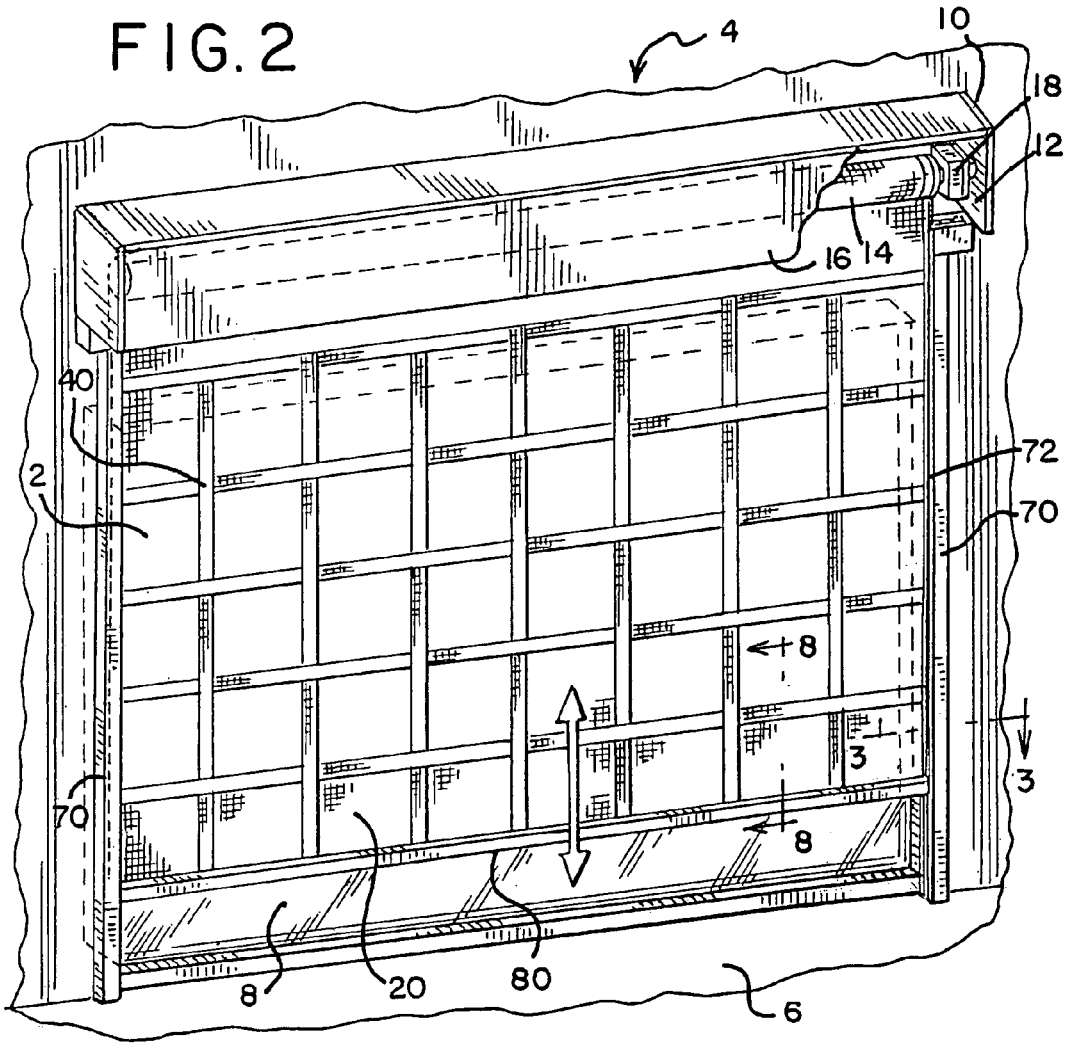
FIG. 2 illustrates a back side perspective view of a fabric security barrier and a system for impeding entry into a space in an embodiment of the present invention.
Figure 8:
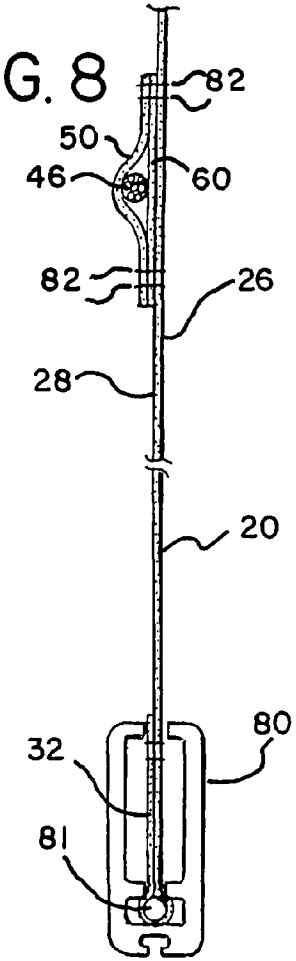
FIG. 8 illustrates a cross-sectional view taken at line 8-8 of FIG. 2 of a fabric security barrier and a system for impeding entry into a space in an embodiment of the present invention.

As shown in FIGS. 2, 4 and 6-8, the back side 28 of the fabric tarp 20 may have reinforced webbing 40 attached thereto. The reinforced webbing 40 may extend across the back side 28 of the fabric tarp 20 from the first end 22 to the second end 24 of the fabric tarp. The reinforced webbing 40 may extend across the back side 28 of the fabric tarp 20 from the bottom end 32 of the fabric tarp 20 to a point between the bottom end 32 of the fabric tarp 20 and the top end 30 of the fabric tarp 20. The reinforced webbing 40 may be an assembly constructed from a plurality of straps 50, a plurality of corresponding cables 46 and/or a plurality of corresponding backing fabric strips 60. As shown in FIGS. 2, 4 and 7, the reinforced webbing may be positioned in a pattern, such as, for example, a grid, a lattice, a matrix and/or a criss-cross pattern on the back side 28 of the fabric tarp 20. In a preferred embodiment, the reinforced webbing 40 may be assembled before affixing the same to the fabric tarp 20. FIG. 8 illustrates layers of the reinforced webbing 40. Each cable 46 may have a length defined between a first end 47 and a second end 48 that may be positioned opposite to the first end 47. The cable 46 may be positioned between the strap 50 and the backing fabric strip 60. The strap 50 may be affixed to the backing fabric strip 60 by, for example, stitching the strap 50 to the backing fabric strip 60 to encase the cable 46 between the strap 50 and the backing fabric strip 60. The assembly of the strap 50, the cable 46 and/or the backing fabric strip 60 may be attached to the fabric tarp 20 with the backing fabric strip 60 abutting the back side 28 of the fabric tarp 20. The assembly of the strap 50, the cable 46 and/or the backing fabric strip 60 may be attached to the fabric tarp 20 using, for example, a double-needle stitching process, an adhesive process and/or the like.

The cable 46 may be, for example, a wire rope that may be constructed from, for example, galvanized steel, stainless steel, iron, aluminum and/or the like. In a preferred embodiment, the cable 46 may have a diameter of at least one quarter of an inch and/or may have an approximate bending radius of five and one quarter inches. The cable 46 may have an average tensile break strength of at least six thousand, one hundred (6,100) pounds.

The strap 50 may be, for example, a nylon webbing similar to a material used to manufacture seat belts in automobiles. The strap 50 may have a width of approximately two inches. The strap 50 may be resistant to acids and other chemicals. Further, the strap 50 may have an average tensile break strength of at least two thousand, four hundred (2,400) pounds.

The backing fabric strip 60, in a preferred embodiment, may be constructed from a same or similar fabric that the fabric tarp 20 may be constructed from, such as, for example, a canvas fabric, a cloth fabric, an acrylic fabric, a vinyl fabric, a solution-dyed acrylic fabric, a vinyl coated woven fabric and/or the like. The backing fabric strip 60 may be used to construct the reinforced webbing 40 before attaching the reinforced webbing 40 to the fabric tarp 20. The reinforced webbing 40 may be manufactured in bulk in advance with the backing fabric strip 60 to increase a speed at which the fabric security barrier 2 may be manufactured.

As shown in FIGS. 2, 4 and 7, the reinforced webbing 40 may be attached to the fabric tarp 20 in horizontal strips 53 and/or in vertical strips 55. The horizontal strips 55 may extend linearly across the length of the fabric tarp 20 from the first end 22 to the second end 24 of the fabric tarp 20. The vertical strips 55 may extend linearly across a portion of the height of the fabric tarp 20 from the bottom end 32 of the fabric tarp 20 to a point between the bottom end 32 of the fabric tarp 20 and the top end 30 of the fabric tarp 20. A length of each of the vertical strips 55 may depend upon a height required by the application. In an embodiment, the vertical strips 55 may extend a length, such as, for example, seven feet eight inches from the bottom end of the fabric tarp 20. However, the vertical strips 55 may have a length that may be selected depending on a size of the entry point 8, a desired maximum weight of the fabric security barrier 2 and/or the like. The horizontal strips 53 and the vertical strips 55 may be woven in an over-under pattern on the back side 28 of the fabric tarp 20 as shown in FIGS. 1, 4 and 7. Alternatively, the horizontal strips 53 and the vertical strips 55 may be over lapped in an over-over pattern (not shown).

In a preferred embodiment, the vertical strips 55 may be separated by a distance of approximately one to two feet, and/or the horizontal strips 53 may be separated by a distance of approximately one to two feet. It is intended that the vertical strips 55 and/or the horizontal strips 53 may be separated by a distance that may prevent a human from cutting the fabric tarp 20 between vertical strips 55 and/or the horizontal strips 53 and passing through the fabric security barrier 2. However, the distance between the adjacent horizontal strips 53 and/or the adjacent vertical strips 55 may be adjusted based upon the application and/or the size of an object, a person and/or a limb that a user may desire to prevent from being passed through the fabric security barrier 2. Moreover, provided that the fabric tarp 20 may be constructed from an opaque material, the placement and/or the location of the reinforced webbing 40 as well as the material construction of the reinforced webbing 40 may not be immediately perceptible to a would-be thief because the reinforced webbing 40 may be disposed on the back side 28 of the fabric tarp 20. In a preferred embodiment, the reinforced webbing 40 may only be visible from the inside of the space 6 while the fabric security barrier 2 is deployed.

As shown in FIG. 4, the fabric tarp 20 may have a webbing-less section 36 between an uppermost horizontal strip 53 and the top end 30 that may not be provided with reinforced webbing 40. The webbing-less section 36 may be out of reach of an intruder; therefore, the fabric tarp 20 may not require the reinforced webbing 40 across an entire surface area of the fabric tarp 20. Further, having the webbing-less section 36 may reduce an overall weight of the fabric security barrier 2. The fabric tarp 20 may have a slack section 34 superior to either the reinforced webbing 40 and/or the webbing-less section 36. The slack section 34 may be an excess length of the fabric tarp 20 to affix the fabric security barrier 2 to a roller tube 14 of a deployment system 10.

Figure 3:
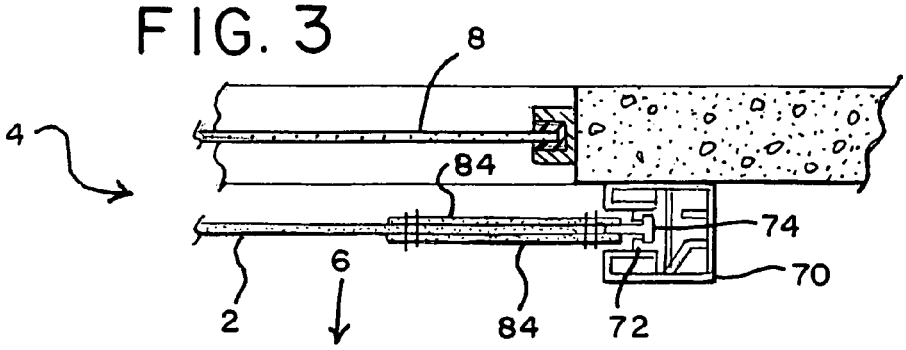
FIG. 3 illustrates a cross-sectional view taken at line 3-3 of FIG. 2 of a fabric security barrier and a system for impeding entry into a space in an embodiment of the present invention.
Figure 5:
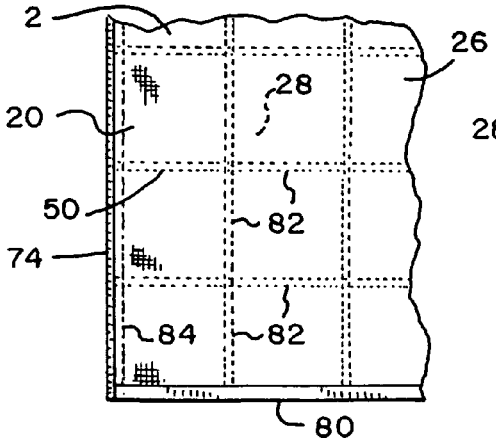
FIG. 5 illustrates a partial front side plan view of a fabric security barrier and a system for impeding entry into a space in an embodiment of the present invention.
Figure 6:
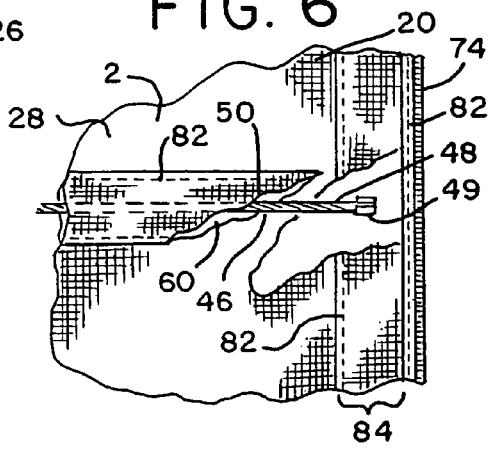
FIG. 6 illustrates a partial back side plan view of a fabric security barrier and a system for impeding entry into a space in an embodiment of the present invention.

To position, to extend and/or to retract the fabric security barrier 2, the system 4 may be provided with the deployment system 10 and/or an end retention system 70, as shown in FIGS. 2, 3 and 5. As discussed herein above, the deployment system 10 may have a roller tube 14 that may be constructed from, for example, aluminum. The roller tube 14 may be attached to, for example, an outer wall of the space 6 inside and/or above the entry point 8 with a mounting bracket 12. At one end of the roller tube 14, a motor 18, such as, for example, an override tubular motor may be provided to rotate the roller tube 14 to extend and/or to retract the fabric security barrier 2. The motor 18 may be controlled electrically with any of a variety of control systems 19, such as, for example, a switch on the inside of the space 6, a security keypad or control box that may be located on an outside of the space 6, a remote control system, a hand crank and/or the like. The roller tube 14 may be covered by a housing 16 to protect and/or to obscure the deployment system 10 and/or the fabric security barrier 2. The present invention should not be deemed as limited to a specific embodiment of the deployment system 10 or of its components. It should be understood that the deployment system 10 and/or its components may be any system for extending and/or for retracting a fabric tarp as known to one having ordinary skill in the art.

As shown in FIGS. 1 and 2, the end retention system 70 may have rails 72 that may be installed on either or both sides of the entry point 8 and/or that may extend from the ground to a point adjacent to the deployment system 10. For use with the end retention system 70, the fabric security barrier 2 may be provided with features that may aid in extension and/or retraction and/or that may prevent the fabric security barrier 2 from being moved from a position covering the entry point 8. As shown in FIGS. 3, 4, 5 and 7, the fabric tarp 20 may have fasteners, such as, for example, zippers 74 at both the first end 22 and the second end 24 that may be embroidered to the fabric tarp 20 to extend from the bottom end 32 towards the top end 30. While the zippers 74 may slide up and down while seated within the rails 72, the zippers 74 may not be pulled outward from the rails 72. In addition to guiding the fabric security barrier 2, the zippers 74 together with the rails 72 may maintain a horizontal tension in the fabric security barrier 2 during deployment, after deployment and/or during retraction. Further, as illustrated in FIGS. 2, 4 and 5, the fabric tarp 2 may have reinforced edges 84 at the first end 22, the second end 24, the bottom end 32 and/or the top end 30. The reinforced edges 84 may have additional material and/or stitching to stiffen the fabric tarp 20 adjacent to the zippers 74. Further the reinforced edges 84 may secure the first end 47 and the second end 48 of the cable 46 to the fabric tarp 20. The reinforced edges 84 may increase a tensile break strength of the fabric tarp 20 from the zippers 74.

The first end 47 and/or the second end 48 of the cable 46 may extend from the horizontal strips 53 at the first end 22 and/or the second end 20 of the fabric tarp 20. The first end 47 and/or the second end 48 may be provided with an end stop 49 that may be, for example, a piece of metal crimped onto the cable 46 to increase a diameter of the cable 46. Each of the end stops 49 may be positioned within the rails 72 which may further increase a tensile break strength of the fabric security barrier 2. Alternatively, the end stops 49 may be embroidered to the fabric tarp 20 with the reinforced edges 84 to prevent a pulling of the cable 46 from the reinforced webbing 40. Likewise, the cable 46 that may line the vertical strips 55 may be provided with the end stops 49 that may be embroidered to the fabric tarp 20 with reinforced edges 84.

As shown in FIGS. 2 and 8, the fabric security barrier 2 may have a hem bar 80 that may be attached to the bottom end 32 of the fabric tarp 20 and/or that may extend from the first end 22 to the second end 24 of the fabric tarp 20. The bottom end 32 of the fabric tarp 20 may be wrapped around a length of tubing 81 and embroidered to itself to create a piped end. The hem bar 80 may be configured to slidably receive the piped end, and/or a force of gravity on the hem bar 80 may hold the hem bar 80 in place clamped around the piped end. The hem bar 80 may be provided in various sizes and weights and/or may maintain a vertical tension in the fabric security barrier 2 during deployment, after deployment and/or during retraction.

In an embodiment, the fabric security barrier 2 and/or the system 4 may be sized for and installed inside of, for example, an exterior window of a building, such as, for example a retail store. The electronic monitoring security system, such as, for example, a glass break sensor may be used to monitor a failure of the exterior window. The deployment system 10 may be mounted above the exterior window, and/or the rails 72 of the end retention system 70 may be installed on both sides of the window. The control system 19 may be installed to electrically operate the motor 18 to rotate the roller tube 14. Further, a hand crank may be provided on the deployment system 10 to manually rotate the roller tube 14. The fabric security barrier 2 may be sized and/or constructed for use based upon a size of the exterior window, the deployment system 10 and/or the rails 72. Further, the front side 26 of the fabric tarp 20 may be provided with the indicia 5 to convey a message. The hem bar 80 may be sized and/or attached to the bottom end 32 of the fabric tarp 20. The slack section 34 at the top end 30 of the fabric tarp 20 may be rolled onto and/or attached to the roller tube 14. The motor 18 may be used to retract the fabric security barrier 2 onto the roller tube 14.

The bottom end 30 of the fabric tarp 20 may be lowered to the rails 72. The zippers 74 at each of the first end 22 and the second end 22 of the fabric tarp 20 may be seated into each of the rails 72. The motor 18 may be activated to deploy the fabric security barrier 2 until the hem bar 80 reaches an end position, such as, for example the ground. The motor 18 may be programmed to store the end position. While deployed, the front side 26 of the fabric tarp 20 and/or any of the indicia 5 thereon may be visible through the exterior window. The reinforced webbing 40 that may be attached to the back side 28 of the fabric tarp 20 may not be visible through the exterior window because of the opacity of the fabric tarp 20. Further, any pliability in the fabric tarp 20 and the end retention system 70 may prevent the fabric security barrier 2 from being lifted from the end position with the hem bar 80. The zippers 74 may resist being bunched within the rails 72, and/or the fabric tarp 20 may further resist bunching. Vertical tension must be present in the fabric tarp 20 to both raise and to store the same. The vertical tension may be created by the weight of the fabric tarp 20, the reinforced webbing 40 and/or the hem bar 80. Therefore, lifting the fabric security barrier 2 from the hem bar 80 may relieve the vertical tension, and the fabric security barrier 2 and/or the end retention system 10 may resist upward movement.

A would-be thief may approach the exterior window to evaluate the security systems of the space 6, any merchandise that may be in the space 6, a presence of any employees and/or security personnel and/or a location of the merchandise with respect to the exterior window. However, the installed and deployed fabric security barrier 2 may be lining an inside of the exterior window. The would-be thief may not be able to ascertain the materials of construction and/or the presence or the configuration of the reinforced webbing 40 of the fabric security barrier 2 on the back side 28 of the fabric tarp 20. Further, the would-be thief may not be able to see any merchandise or any location of the merchandise. Further, the would-be thief may not be able to ascertain whether any employees and/or security personnel are present in the building. Likewise, the would-be thief may not be able to ascertain whether any lights are illuminated in the building. The would-be thief may be deterred from attempting a theft through the exterior window because of the amount of information obscured by the fabric security barrier 2. The fabric security barrier 2 may lead the would-be thief to be uncertain as to whether an opportunity to successfully perpetrate a theft exists; therefore, the would-be thief may avoid any attempt to perpetrate a theft. Moreover, the fabric security barrier 2 and/or the system 4 may not be visible from inside the space 6 when rolled up and onto the roller tube 14. The material of construction and/or the configuration of the reinforced webbing 40 may not be visible while not deployed because the fabric security barrier 2 may be rolled onto the roller tube 14 and/or may be obscured by the housing 16.

In the event that the would-be thief chooses to attempt to perpetrate a theft while the fabric security barrier 2 is deployed, the would-be thief may break or shatter the exterior window. The glass break sensor may detect a failure of the window, may sound an alarm and/or may notify appropriate security and/or law enforcement personnel. The would-be thief must undertake to pass the fabric security barrier 2, which may be positioned only a few inches from the broken window. Glass and/or sharp edges may further hamper passage into space 6 by the would-be thief.

The would-be thief, in a matter of seconds, must compromise the fabric tarp 20, the cables 46 and/or the straps 50 to enter the space 6 in time conduct a theft and to flee the premises before security and/or law enforcement personnel arrive. The would-be thief may have to egress the space 6 through the compromised fabric security barrier 2. The time needed by the would-be thief to evaluate the fabric security barrier 2 and/or the system 4 and to compromise and/or to pass the same, which may take minutes, may highly reduce the chances of success of the would-be thief. It is intended that the fabric security barrier 2 and/or the system 4 are a deterrent to thefts. Moreover, the fabric security barrier 2 and/or the system 4 may lead to failed attempts and/or may lead to immediate and successful apprehension of suspects while the thefts are in progress.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A security barrier for impeding entry into a space, the security barrier comprising:

a tarp having a length defined between a first end and a second end wherein the second end is positioned opposite to the first end wherein the tarp has a thickness defined between a front side and a back side wherein the back side is positioned opposite to the front side wherein the tarp has a height defined between a top end and a bottom end wherein the bottom end is positioned opposite to the top end wherein the tarp is constructed from a pliable fabric;

a first plurality of straps affixed to the back side of the tarp wherein the first plurality of straps extend continuously from the first end of the tarp to the second end of the tarp wherein the first plurality of straps is constructed from a webbing material;

a second plurality of straps affixed to the back side of the tarp wherein the second plurality of straps extend from the bottom end of the tarp to a point between the bottom end of the tarp and the top end of the tarp wherein each of the second plurality of straps intersects with each of the first plurality of straps wherein the second plurality of straps is interwoven with the first plurality of straps and further wherein the second plurality of straps is constructed from the webbing material;

a first plurality of cables each having a first end and second end wherein each of the first plurality of cables is positioned between each of the first plurality of straps and the back side of the tarp wherein each of the first plurality of cables extends from the first end of the tarp to the second end of the tarp wherein the first plurality of cables is constructed from a wire rope; and a second plurality of cables each having a first end and a second end wherein each of the second plurality of cables is positioned between each of the second plurality of straps and the back side of the tarp wherein each of the second plurality of cables extends from the bottom end of the tarp to the point between the bottom end of the tarp and the top end of the tarp wherein the second plurality of cables is constructed from the wire rope.

2. The security barrier of claim 1 further comprising:

a hem bar attached to the bottom end of the tarp that extends from the first end of the tarp to the second end of the tarp wherein the hem bar places tension on the tarp with a force of gravity.

3. The security barrier of claim 1 further comprising:

zippers attached to the first end and the second end of the tarp that extend from the bottom end of the tarp to a point adjacent to the top end of the tarp.

4. The security barrier of claim 1 further comprising:

a section of the tarp between the point and the top end of the tarp that is devoid of the first plurality of straps, the second plurality of straps, the first plurality of cables and the second plurality of cables.

5. The security barrier of claim 1 further comprising:

an end stop attached to each of the first end and the second end of each of the first plurality of cables and each of the second plurality of cables wherein the end stop prevents each of the first plurality of cables and each of the second plurality of cables from being maneuvered with respect to the back side of the tarp.

6. The security barrier of claim 1 further comprising:

a fabric strip positioned between each of the first plurality of cables and the back side of the tarp and between each of the second plurality of cables and the back side of the tarp.

7. The security barrier of claim 1 further comprising:

strips of the pliable fabric laminated to the first end and the second end of the tarp to reinforce the first end and the second end of the tarp.

8. The security barrier of claim 1 wherein the pliable fabric is selected from the group consisting of a woven fabric, a non-woven fabric, a canvas fabric, a cloth fabric, an acrylic fabric, a vinyl fabric, a solution-dyed acrylic fabric and a vinyl coated woven fabric.

9. The security barrier of claim 1 wherein the wire rope is constructed from the group consisting of galvanized steel, stainless steel and aluminum.

10. The security barrier of claim 1 wherein the webbing material is a nylon webbing.

11. The security barrier of claim 1 wherein the tarp is opaque.

12. A system for securing an entry point of a space, the system comprising:

a barrier sized to cover the entry point wherein the barrier has a first end and a second end wherein the second end is positioned opposite to the first end wherein the barrier has a front side and a back side wherein the back side is positioned opposite to the front side wherein the barrier has a top end and a bottom end wherein the bottom end is positioned opposite to the top end wherein the barrier is pliable;

a webbing attached to the back side of the barrier wherein the webbing is woven together to form a crisscross pattern wherein the webbing is reinforced with a wire rope between the webbing and the back side of the barrier;

a roller tube installed within the space above the entry point wherein the top end of the barrier attaches to the roller tube wherein the roller tube rotates to extend and retract the barrier; and rails installed adjacent to the entry point wherein the rails receive the first end and the second end of the barrier wherein the rails guide an extension and a retraction of the barrier and further wherein the rails maintain a horizontal tension in the barrier.

13. The system of claim 12 further comprising:

a motor attached to the roller tube to rotate the roller tube.

14. The system of claim 12 further comprising:

a control system remotely located with respect to the roller tube wherein the control system controls rotation of the roller tube.

15. The system of claim 12 further comprising:

indicia displayed on the front side of the barrier.

16. A method for interfering with a progress of an unwanted intrusion through an entry point of a space wherein the entry point is monitored by an electronic security system, the method comprising the steps of:

providing a barrier having a tarp with a front side and a back side wherein the tarp has a cable-reinforced nylon webbing attached to the back side of the tarp in a woven lattice pattern wherein the barrier is sized to cover the entry point wherein the barrier has a deployment system to raise and lower the barrier and further wherein the barrier has an end retention system to maintain a position of the barrier over the entry point;

lowering the barrier through the end retention system with the front side facing the entry point to cover the entry point within the space; and arming the electronic security system.

17. The method of claim 16 further comprising the step of:

raising the barrier from the end retention system to uncover the entry point.

18. The method of claim 16 further comprising the step of:

displaying indicia on the front side of the tarp.

19. The method of claim 16 further comprising the step of:

positioning the barrier with the back side of the tarp facing into the space to obscure the cable-reinforced nylon webbing from view through the entry point.

* * * * *